United States Patent [19]

Huelsekopf

[11] 4,407,100

[45] * Oct. 4, 1983

[54] WINDOW FRAME ASSEMBLY WITH FRAME SHAPED LOCKING MEMBER

[75] Inventor: Alfred G. Huelsekopf, Newmarket, Canada

[73] Assignee: Com-Dor Supply Limited, Downsview, Canada

[ * ] Notice: The portion of the term of this patent subsequent to Jul. 28, 1998 has been disclaimed.

[21] Appl. No.: 196,479

[22] Filed: Oct. 14, 1980

[51] Int. Cl.[3] ..... E06B 1/04

[52] U.S. Cl. ..... 52/212; 52/400; 52/475; 52/455; 52/824; 52/656; 49/504

[58] Field of Search ..... 52/212, 217, 211, 206, 52/205, 377, 455, 824, 656, 400, 475; 49/504, 505, 171, 476, 822, 824; 40/157, 152

[56] References Cited

U.S. PATENT DOCUMENTS

| | | | |
|---|---|---|---|
| 3,555,736 | 1/1971 | Koch | 49/504 |
| 3,566,565 | 3/1971 | Pond | 52/208 |
| 3,711,995 | 1/1973 | Anderson | 49/504 |
| 3,744,201 | 7/1973 | Dochnahl | 52/400 |
| 3,750,358 | 9/1973 | Lewkowitz | 52/400 |
| 3,760,543 | 9/1973 | McAllister | 52/455 |
| 3,800,488 | 4/1974 | Swanson | 52/212 |
| 3,903,669 | 9/1975 | Pease | 52/455 |
| 4,241,556 | 12/1980 | Bursk | 52/455 |
| 4,280,309 | 7/1981 | Huelsekopf | 52/212 |

FOREIGN PATENT DOCUMENTS

| | | | |
|---|---|---|---|
| 89672 | 9/1960 | Denmark | 52/455 |
| 1934548 | 1/1971 | Fed. Rep. of Germany | 49/505 |
| 2242431 | 2/1974 | Fed. Rep. of Germany | 52/212 |
| 2517207 | 10/1976 | Fed. Rep. of Germany | 52/208 |

*Primary Examiner*—John E. Murtagh
*Assistant Examiner*—Henry E. Raduazo
*Attorney, Agent, or Firm*—Fetherstonhaugh & Co.

[57] ABSTRACT

A window frame assembly which comprises a first intermediate frame member and a second intermediate frame member adapted to be inserted from opposite sides of a window opening to embrace the edges of the window opening. The first frame member has a locking channel extending about the periphery of its inner end and the second intermediate channel has locking tongues projecting inwardly therefrom which are adapted to be inserted within the locking channel of the first intermediate member. The second intermediate frame comprises a plurality of frame lengths connected to one another at opposite ends to form corners of the second intermediate frame. A locking tongue formed on each length terminates short of the corners of the second intermediate frame so that the locking tongues are independently flexible to facilitate the insertion of the locking tongues within the locking channels when the second intermediate frame is interlocked with the first intermediate frame in use.

2 Claims, 3 Drawing Figures

WINDOW FRAME ASSEMBLY WITH FRAME SHAPED LOCKING MEMBER

This invention relates to window frame assemblies.

PRIOR ART

In my prior application Ser. No. 100,831 filed Dec. 6, 1979, I have proposed a structure in which a first intermediate frame is formed and is retained in the window opening by locking rails, each of which are independent of one another.

The locking rails were initially made as separate lengths to facilitate the mounting of the frame in a window opening. The locking rails were not connected to one another to form a frame because it was believed that it would have been too difficult to match the size of the frame formed by the locking rails to the size of the frame formed by the main frame members. It would, however, have been desirable to connect the locking rails so that the frame formed by the locking rails would have a more finished appearance on the inner edge of the window opening.

I have now discovered that by the simple expedient of terminating the locking tongues inwardly from the ends of each length of locking rail, it is possible to connect the ends of the locking rails to form a second intermediate frame which can be interconnected with a first intermediate frame by insertion of the locking tongues into the locking channels of the associated frame members. By reason of the fact that the locking tongues of the second intermediate frame are independent of one another, a sufficient degree of flexibility in the proportions of the locking tongues is obtained to permit preassembly of the second intermediate frame member. Thus, it is possible to preassemble the first intermediate frame member and to preassemble the second intermediate frame member in a production assembly shop and to assemble the window merely by interlocking a first intermediate frame with a second intermediate frame.

SUMMARY OF INVENTION

According to one aspect of the present invention there is provided a window assembly which comprises a first intermediate frame comprising a plurality of first frame lengths which butt at opposite ends to form corners of the first intermediate frame, said first intermediate frame being adapted to be inserted within a window opening in a close fitting relationship and having means on one side thereof for bearing against a peripheral edge of the window opening to prevent direct passage of the first intermediate frame through the window opening, a mounting slot formed in and extending about the periphery of the first intermediate frame, said mounting slot being arranged to be accessible from the other side of said frame when the first intermediate frame is mounted in a window opening, a second intermediate frame comprising a plurality of second frame lengths which butt at opposite ends to form corners of the second intermediate frame, each of said lengths being coextensive with a corresponding length of said first intermediate frame, each of the lengths of the second frame having a locking tongue projecting therefrom which is adapted to be inserted within a locking channel of its associated first frame member, the locking tongues of each second frame length being spaced from one another at the corners of the second intermediate frame so as to be independently flexible to facilitate the insertion of the locking tongues within the locking channels when the second intermediate frame is interconnected to the first intermediate frame.

PREFERRED EMBODIMENT

The invention will be more clearly understood after reference to the following detailed specification read in conjunction with the drawings wherein, FIG. 1 is an exploded view of the first and second intermediate frames arranged for insertion into a window opening;

Figure 1:
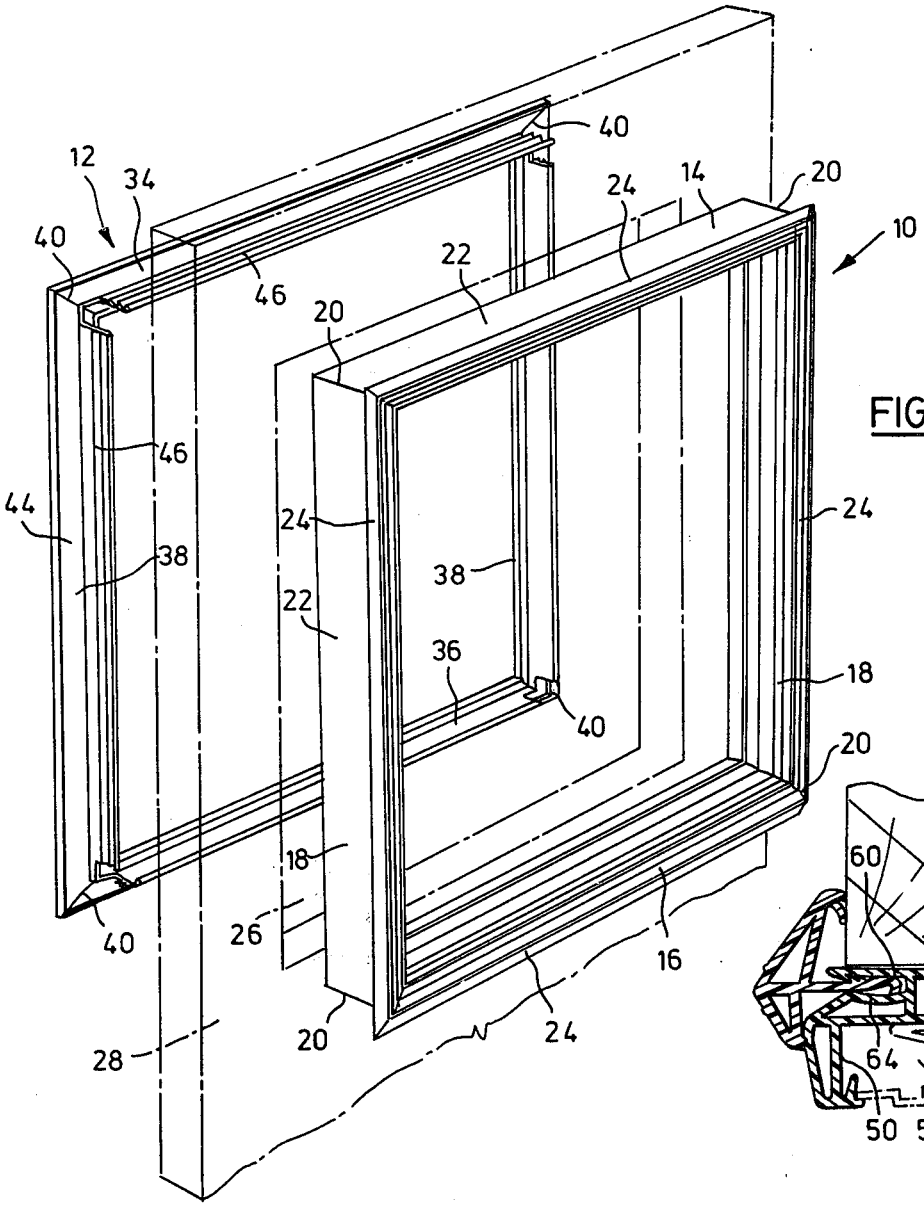

With reference to FIG. 1 of the drawings, the reference numeral 10 refers generally to a first intermediate frame and the reference numeral 12 refers generally to a second intermediate frame. The first intermediate frame 10 comprises a plurality of first frame lengths which include a header 14, a sill 16 and a pair of oppositely disposed side rails 18 which butt one another at opposite ends to provide corners 20. The lengths of first frame member are secured by means of adhesive or any other convenient securing mechanism so that the first intermediate frame is retained in the configuration of a frame. Each of the first frame lengths is formed with a laterally extending wall 22 and an outwardly extending flange 24. The laterally extending walls 22 are proportioned to fit in a close fitting relationship within the opening 26 of a door 28 or the like. The flanges 24 project outwardly a sufficient extent to bear against the peripheral edge of the window opening 26.

The second frame comprises a header rail 34, sill rail 36 and oppositely disposed side rails 38 which are connected to one another at corners 40 by means of an adhesive or the like to provide a frame configuration proportioned to correspond to the frame configuration of the first intermediate frame 10. Each of the locking rails comprises a flange 44 and a tongue 46. The flange 44 is proportioned to bear against the edge of the body in which the window opening is formed. Each of the tongues 46 terminates at a point spaced inwardly from the end of its associated second frame member so that the tongues 46 may flex relative to their associated flange 44 and relative to one another. Barbs 48 are formed on the tongue 46.

Figure 2:
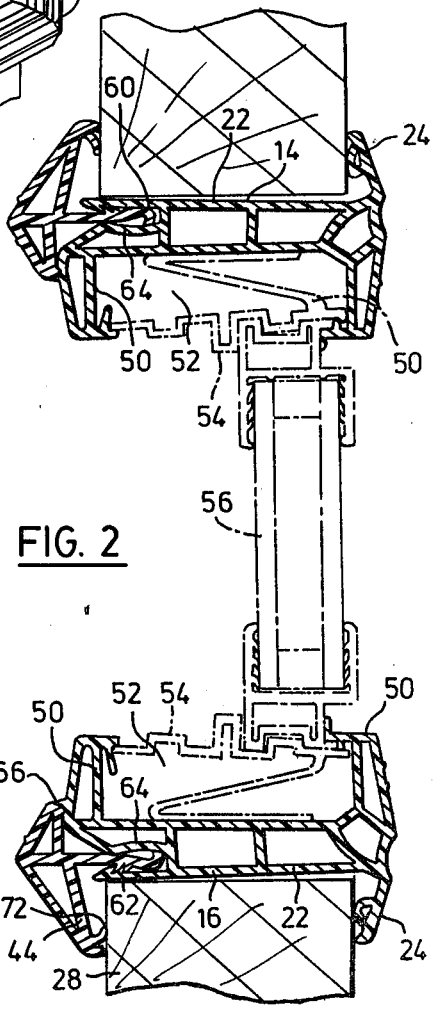
FIG. 2 is a cross-sectional view taken through an assembled frame.

As shown in FIG. 2 of the drawings, the header 14 and the sill 16 of the first intermediate frame are each formed from an extruded plastic member in which the laterally extending wall 22 and the flange 24 are integrally formed. A pair of inwardly projecting side walls 50 serve to form a channel 52 in which a window retaining structure 54 is located for use in retaining a window 56. It will be understood that the side rails 18 may have the same cross-sectional configuration as the header and sill rails.

A locking channel 60 is formed in each of the first intermediate frame members and extends longitudinally thereof so as to provide a substantially continuous locking channel extending about the inwardly directed periphery of the intermediate frame. The locking channel 60 is accessible to the tongue 46 of the locking rails of the second intermediate frame, as shown in FIG. 2. The locking channel 60 has an inwardly directed barb 62 and is proportioned so as to be slightly narrower than the outer end of the locking tongue 46. The inner wall 64 of the locking channel 60 is resiliently flexible to permit the insertion of the locking tongue 46 while retaining a pressure against the locking tongue serving to force the barbs 48 into engagement with the bar 62.

A stabilizing shoulder 66 projects outwardly from the side face of the inner wall of the first frame members and extends longitudinally thereof.

Figure 3:
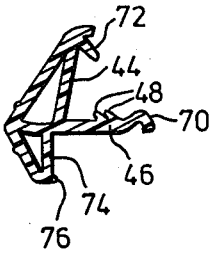
FIG. 3 is a cross-sectional view of a length of the mounting rail of the second intermediate frame.

Each of the rails which form the lengths of the second frame member have a cross-section corresponding to that illustrated in FIG. 3 of the drawings. As previously indicated, each rail has a tongue portion 46 in which a pair of barbs 48 are provided. The outer edge of the tongue 46 is formed with an arcuate shaped ridge 70. The flange 44 has a flexible lip 72 projecting inwardly therefrom which serves to provide a fluid-tight seal in use. Each rail member also has an arm 74 projecting outwardly from the tongue 46 on the side opposite the flange 44. Ridge 76 is formed at the outer end of the arm 74. The ridge 76 serves to interlock with the shoulder 66 of the first frame member to resist movement of the flange 44 away from the body of the door 28 in use. As shown in FIG. 1 of the drawings, the first intermediate frame is preassembled to a frame configuration prior to mounting in the opening 26. Thus, all of the joints formed at the corners 20 can be bonded or fused to one another to provide a fluid-tight connection therebetween. Similarly, the various lengths of the second intermediate frame 12 may be bonded or fused to one another to form an integral intermediate second frame with the locking tongues 46 projecting rearwardly therefrom and being independently flexible. By reason of the fact that the tongues 46 are independently flexible, minor differences between the length of the various locking rails and their associated first intermediate frame member can be accommodated.

Thus, the structure of the present application permits the preassembly of the first intermediate frame and the preassembly of the second intermediate frame so that in the installation of the window frame it is merely necessary for the first intermediate frame to be inserted into the window opening and thereafter the second intermediate frame is connected to the first intermediate frame to lock the assembly in the window opening.

A further important feature of the present invention is in the provision of the arm 74 projecting from the tongue 46 on the side opposite to the side in which the flange 44 projects. The arm 74 serves to apply a moment about the tongue 46 which resists the bending moment applied by the flange 44 when the lip 72 is brought into engagement with the body in which the window opening is formed. This structure ensures that an adequate sealing force is applied to the flexible lip 72 when the window frame is mounted in a body having a thickness within a predetermined range.

These and other advantages of the window frame of the present invention will be apparent to those skilled in the art.

I claim:

1. A window frame assembly comprising:

(a) a first intermediate frame comprising a plurality of longitudinally elongated first frame lengths which butt and are secured at opposite ends to form corners of the first intermediate frame, said first intermediate frame being adapted to be inserted within a window opening in a close fitting relationship and having a flange on one side thereof for bearing against a peripheral edge of the window opening to prevent direct passage of the first intermediate frame through the window opening, locking channel formed in and extending about the periphery of the first intermediate frame, said locking channel being arranged to be accessible from the other side of said frame when the first intermediate frame is mounted in a window opening, (b) a second intermediate frame comprising a plurality of second frame lengths which butt and are secured at opposite ends to form corners of the second intermediate frame, each of said lengths being coextensive with a corresponding length of said first intermediate frame, each of the lengths of the second frame having a one-piece locking tongue formed integrally therewith and projecting therefrom each tongue being adapted to be inserted within the locking channel of its associated first frame member, the locking tongues of each second frame length extending continuously along a major portion of the length thereof and being spaced a short distance from one another at the corners of the second intermediate frame so as to be independently flexible to facilitate the insertion of the locking tongues within the locking channels when the second intermediate frame is interconnected to the first intermediate frame.

2. A window frame assembly as claimed in claim 1 wherein each second intermediate frame further comprises a flange projecting inwardly from one side of the locking tongue to be disposed opposite the flange of its associated first intermediate frame member and an arm projecting outwardly from the opposite side of the locking tongue to bear against an adjacent portion of its associated first intermediate frame to resist movement of the flange of the second intermediate frame away from the flange of the first intermediate frame in use.

* * * * *